US005580070A

United States Patent [19]

Bekessy

[11] Patent Number: 5,580,070

[45] Date of Patent: Dec. 3, 1996

[54] ADJUSTABLE SKATE TRUCK ASSEMBLY

[75] Inventor: George J. Bekessy, Post Falls, Id.

[73] Assignee: All American Aviation & Mfg. Inc.

[21] Appl. No.: 327,298

[22] Filed: Oct. 21, 1994

[51] Int. Cl.[6] ..... A63C 17/04

[52] U.S. Cl. ..... 280/11.27; 280/11.22; 280/11.26

[58] Field of Search ..... 280/11.22, 11.27, 280/11.26

[56] References Cited

U.S. PATENT DOCUMENTS

| | | | |
|---|---|---|---|
| 2,203,278 | 6/1940 | Foley | 280/11.12 |
| 2,868,553 | 1/1959 | Rieckman | 280/11.12 |
| 2,985,461 | 5/1961 | Lynn et al. | 280/7.13 |
| 4,008,901 | 2/1977 | Conn | 280/7.13 |
| 4,047,725 | 9/1977 | Pinchock | 280/11.28 |
| 4,114,295 | 9/1978 | Schaefer | 36/100 |
| 4,328,627 | 5/1982 | Sanders | 36/115 |
| 4,666,169 | 5/1987 | Hamill et al. | 280/11.23 |
| 4,838,564 | 6/1989 | Jarvis | 280/11.28 |
| 4,932,675 | 6/1990 | Olson et al. | 280/7.13 |
| 5,022,668 | 6/1991 | Kenny | 280/7.14 |
| 5,046,746 | 9/1991 | Gierveld | 280/11.22 |
| 5,253,884 | 10/1993 | Landers | 280/11.27 |
| 5,257,793 | 11/1993 | Fortin | 280/11.22 X |
| 5,295,701 | 3/1994 | Reiber et al. | 280/11.22 |
| 5,314,199 | 5/1994 | Olson et al. | 280/7.13 |
| 5,366,232 | 11/1994 | Pozzobon et al. | 280/11.22 |
| 5,398,970 | 3/1995 | Tucky | 280/11.27 X |
| 5,449,183 | 9/1995 | Klamer et al. | 280/11.27 |
| 5,513,862 | 5/1996 | Chuang | 280/11.27 X |

*Primary Examiner*—Christopher P. Ellis

*Attorney, Agent, or Firm*—Wells, St. John, Roberts, Gregory & Matkin P.S.

[57] ABSTRACT

An adjustable skate truck assembly is described that is mountable to an elongated skate boot. The assembly includes an upper attachment member with heel and toe pieces for mounting to the sole of the skate boot. A skate truck member is mounted to the upper member, for adjustment to vary the relationship of the upper member and boot to a surface support member on the truck. A drive operatively interconnects the upper attachment member and the skate truck member to move the skate truck member and surface support member laterally, elevationally, or both, relative to the upper attachment member. This enables the skater to adjust lateral positioning of the surface support member relative to the upper attachment member. The drive includes a first drive portion that is situated to laterally adjust a toe portion of the truck member relative to the upper attachment member and boot. A second drive operatively interconnects heel piece and truck to enable lateral adjustment of the heel piece relative to the truck. A third drive at the heel end of the truck is operable to elevationally adjust the height of the heel section of the skate boot relative to the surface support member.

18 Claims, 7 Drawing Sheets

FIG. II

ADJUSTABLE SKATE TRUCK ASSEMBLY

TECHNICAL FIELD

This invention relates to adjustable skates, particularly in-line roller skates and ice skates.

BACKGROUND OF THE INVENTION

Almost every skater has a different leg structure in which the skater's legs are bowed in or bowed out, applying different pressures to the inside and outside of their feet. Furthermore it is not unusual for a skater to have one leg that is slightly shorter than the other. Natural toe-in or toe-out foot orientations also differ.

Such variances between skaters frequently makes skating painful and invariably more fatiguing, since mass-produced skates cannot take individual differences into consideration. Skating (in-line roller skating and ice skating) are particularly stressful on a skaters legs and back because the weight of the skater is transferred through the legs and feet to a thin line of contact with the skating surface. This is in contrast to walking and running in which the runner's weight is distributed over more than a thin line contact with the ground. In skating the side to side stress is generally much more concentrated and exacerbated.

One of the principal objects and advantages of this invention is to provide a very precise and easy technique for adjusting skates to provide accurate lateral adjustment to fit the individual desires and leg structure.

A further object and advantage of this invention is to provide a very precise and easy to adjust mechanism for moving the toe and/or heel of the skate boot inward or outward to accommodate for the foot pronation of the skater.

Another object and advantage of this invention is to provide a very precise and easy to adjust mechanism for adjusting the heel height of the skate to accommodate different length legs of the skater.

These and other advantages and objectives of this invention will become apparent upon reading the following detailed description of a preferred embodiment of this invention.

DESCRIPTION OF THE DRAWINGS

Preferred embodiments of the invention are described below with reference to the accompanying drawings, which are briefly described below.

DETAILED DESCRIPTION OF THE PREFERRED EMBODIMENTS

This disclosure of the invention is submitted in furherance of the constitutional purpose of the U.S. Patent Laws "to promote the progress of science and useful arts" (Article 1, Section 8).

Figure 1:
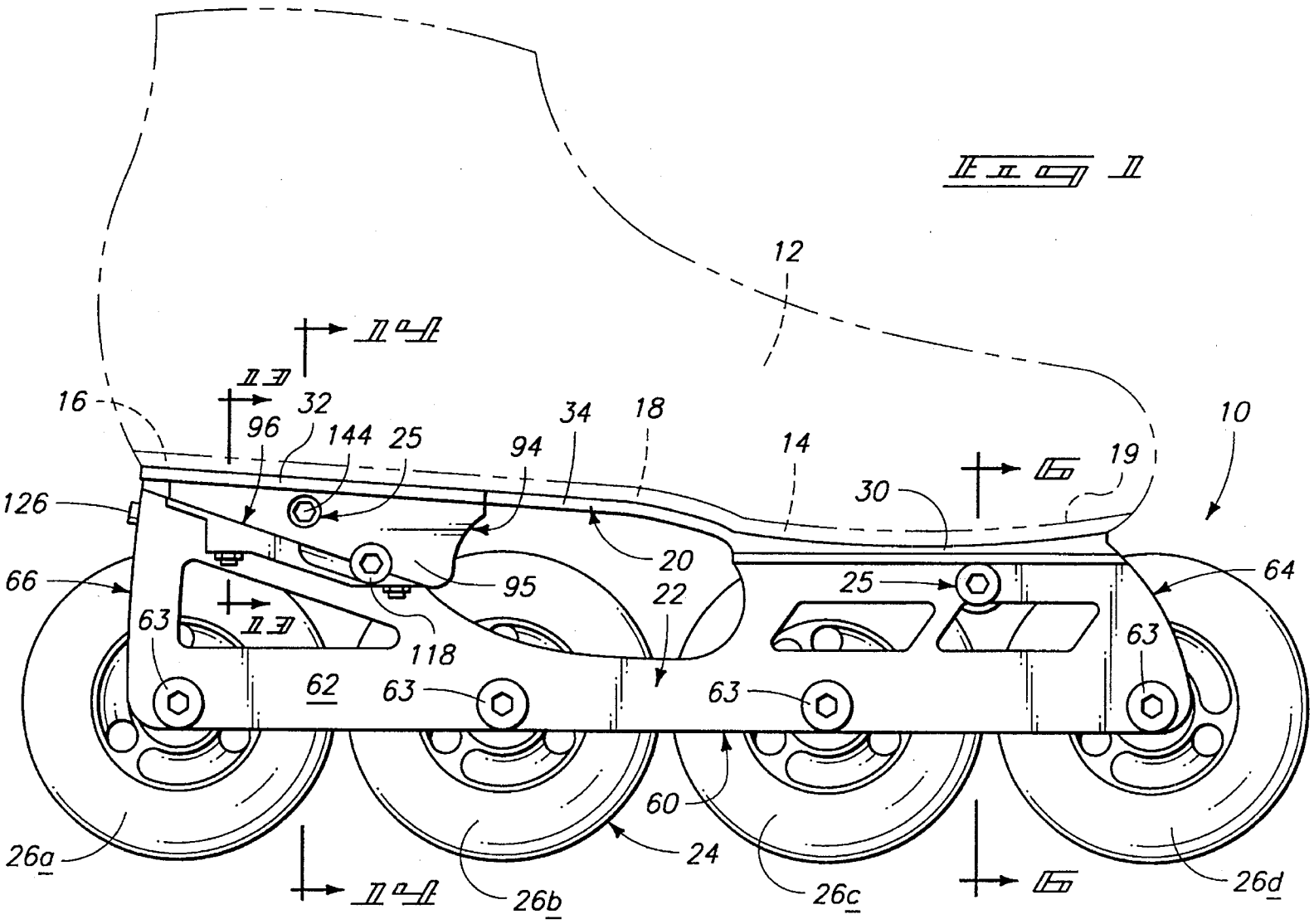
FIG. 1 is a side view of a preferred embodiment of an adjustable skate truck assembly that is mountable to the sole of a skate boot.

Turning in detail to the drawings, there is illustrated in FIG. 1 an adjusting skate truck assembly generally desingated with the numeral 10 for mounting to a skate boot 12 having a bottom sole 14. The boot sole 14 extends from a heel section 16 through an instep section 18 to a toe section 19.

The truck assembly 10 includes an upper attaching member generally designates with the numeral 20 for attaching the assembly to the sole 14. The truck assembly 10 also includes a skate truck member generally designates with the numeral 22 and a surface engaging member 24.

In the preferred embodiments, the surface engaging member 24 includes a plurality of in-line skate wheels **26*a–d*. Alternatively, the surface engaging member 24 could be an ice skate runner. The skate truck assembly 10** is equally appliacable to an in-line skate or to an ice skate.

Figure 2:
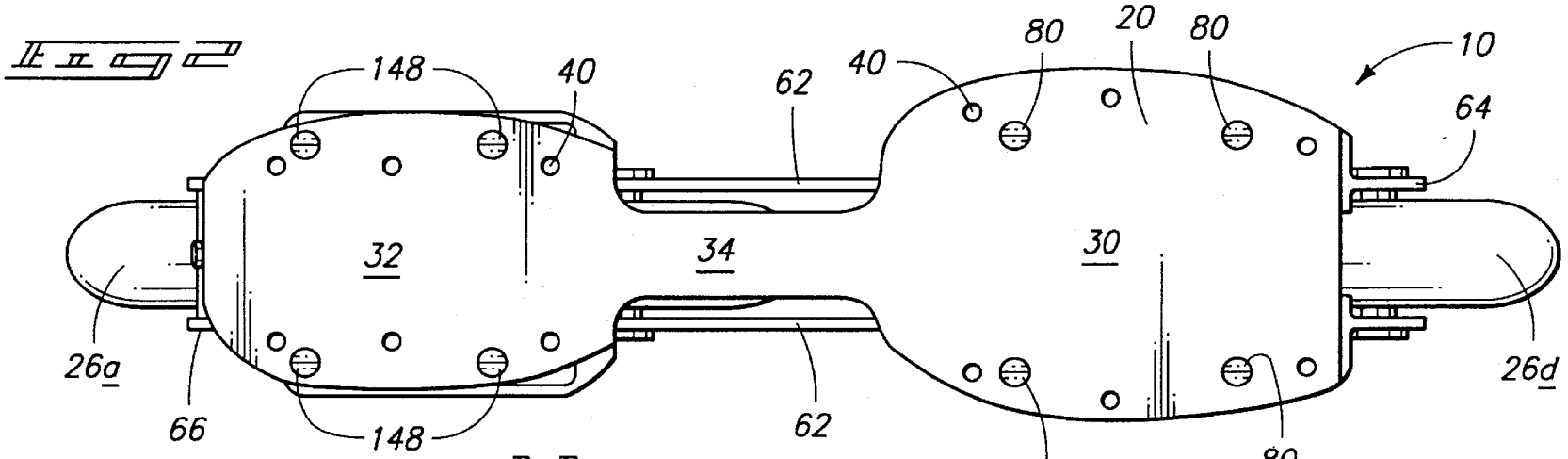
FIG. 2 is top view of the skate truck assembly illustrated in FIG. 1.
Figure 4:
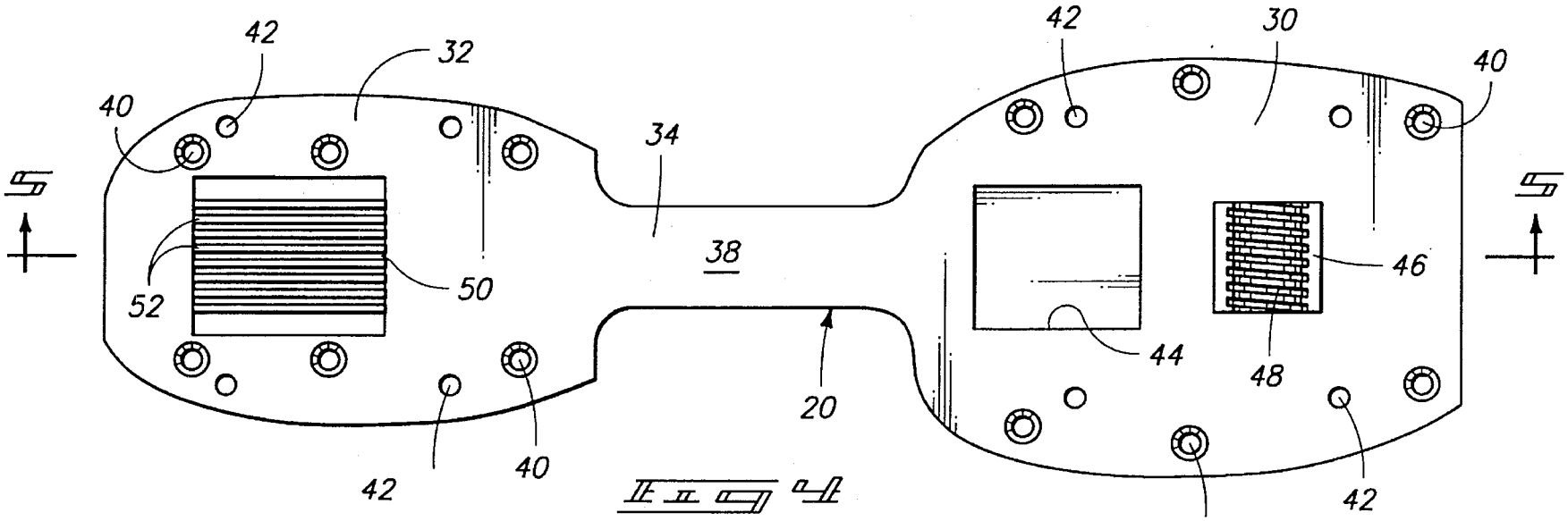
FIG. 4 is a bottom view of the upper member.
Figure 5:
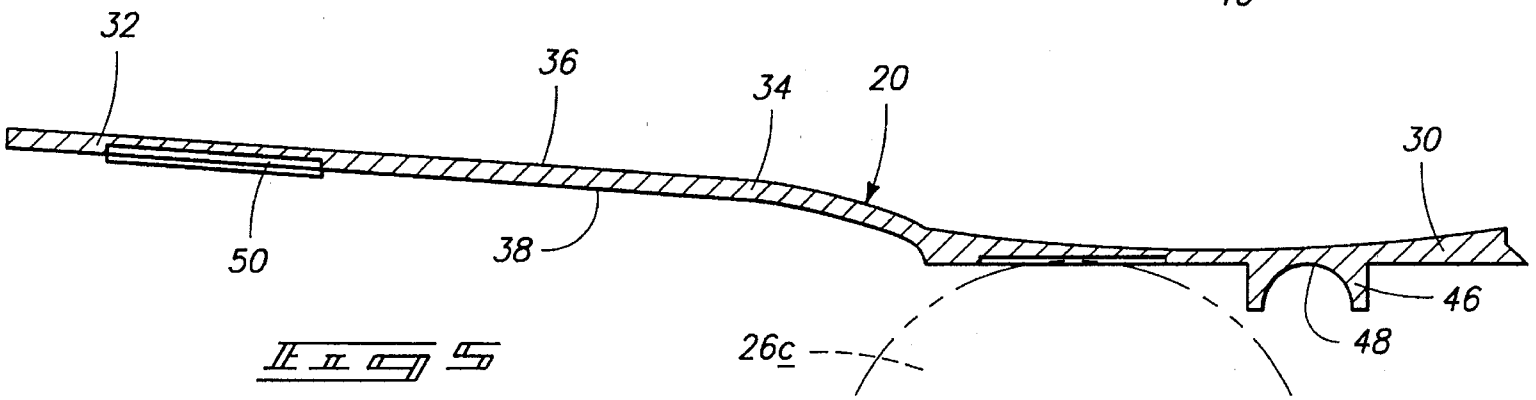
FIG. 5 is vertical cross sectional view taken along line 5—5 in FIG. 4.

The upper attaching member 20, as more specifially illustrated in FIGS. 2, 4 and 5, has a toe piece 30, a heel piece 32 and an instep piece 34. In an alternate embodiment, the upper attaching member 20 may include separate toe and heel pieces 30 and 32 without the interconnecting instep piece 34. The instep piece 34 increases the rigidity of the skate truck assembly 10.

The upper attaching member 20 is preferably composed of high-strength plastic material such as polyurethane containing high-strength embedded fibers. It could also be constructed of other strong light-weight materials such as aluminum. The upper attaching member 20 includes a top surface 36 and a bottom surface 38. The bottom surface 38 is illustrated in detail in FIGS. 4 and 5. The top surface 36 is illustrated in FIG. 2.

The upper attaching member 20 as illustrated in FIGS. 2 and 4 includes a plurality of rivet holes 40 that extend upward from the bottom surface 38 to the top surface 36 for receiving rivets, screws or bolts (not shown) that extend from the bottom surface 38 through the upper attaching member 20 and into the sole 14 for affixing the assembly 10 to the skate boot 12. Alternatively the upper attaching member could be made integral with the boot or be attached thereto by appropriate adhesives. Additionally, the upper attaching member 20 includes a plurality of bolt holes 42 that extend downward to receive a lock (in the form of lock bolts 80) for attaching the upper attaching member to the skate truck member 22.

As illustrated in FIG. 4, the bottom surface 38 has a recess 44 formed therein to provide clearance for the wheel 26*c* so that the elevation of the boot from the ground is minimized.

A drive 25 is provided to operatively interconnect the upper attaching member 20 and truck member 22. The drive 25 functions generally to move the truck member 22 and support member 24 laterally relative to the upper attachment member. In one preferred form, the drive is provided in three portions, a first drive portion relates to lateral positioning of the toe, a second drive portion relates to lateral positioning of the heel, and a third drive portion relates to elevational positioning of the heel. The drive 25 thus affords the skater significant adjustability of his or her foot position relative to the surface support member 24.

The upper attaching member 20 includes part of the first drive portion, a toe piece lead screw rack section 46 that projects downwardly as illustrated in FIG. 5 for engaging a lead screw that will be discussed further below. The section 46 includes a curved half-nut lead screw thread portion 48 (FIGS. 4 and 5).

The heel piece 32 also includes part of the second drive portion, a slotted heel lead screw section 50 that projects downwardly providing flat lead screw threads 52 for engaging a lead screw which will also be discussed below.

The third drive portion includes a lift 94 used to elevationally move the heel piece 32.

The skate truck member 22 includes a general frame 60 that includes longitudinal sides or rails 62. In the preferred embodiment, the in-lines wheels 26*a–d* are mounted between the side rails 62 by axle bolts 63 (FIG. 1). The frame 60 includes a toe section 64 and a heel section 66.

Figure 6:
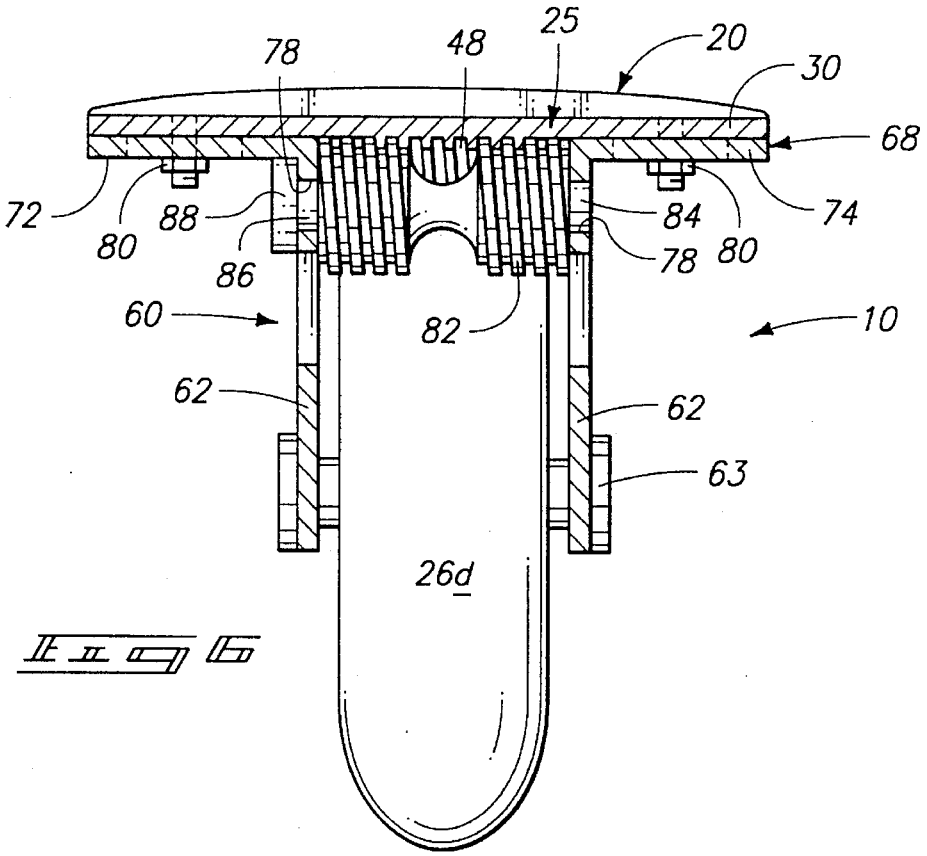
FIG. 6 is transverse vertical cross sectional view taken along line 6—6 in FIG. 1 illustrating a lead screw drive shaft.
Figure 7:
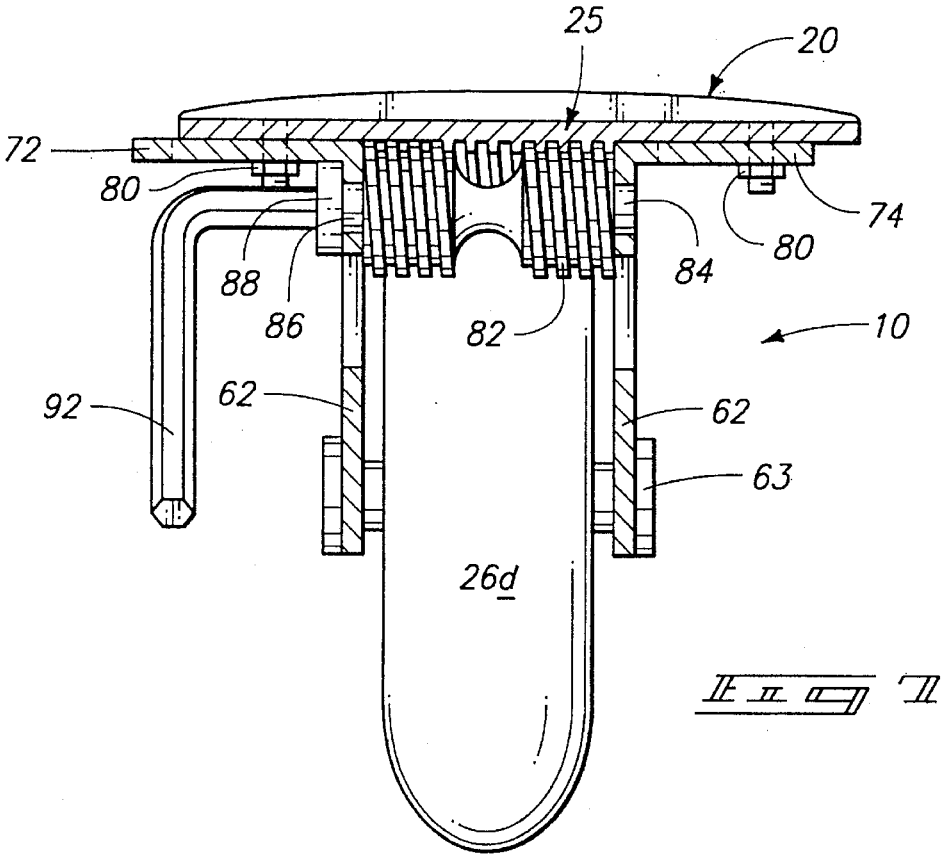
FIG. 7 is transverse vertical cross sectional view similar to FIG. 6 except showing the use of a hex hand tool for rotating the lead screw drive shaft.

The toe section 64 includes an upper flange 68 (FIG. 3) that has a central portion 70 and wing portions 72 and 74. The wing portions 72 and 74 have transverse elongated bolt slots 76 formed therein for facilitating mounting and lateral relative sliding movement of the skate truck member 22 to the upper attaching member 20. Additionally, the rails 62 along the toe section 64 include opposed apertures 78 (FIGS. 6 and 7) for receiving a lead screw shaft 82. The shaft 82 has reduced end bearing studs 84 and 86 that are rotatably mounted in respective apertures 78 in the sides 62. The bearing stud 86 has a bolt head 88 formed thereon to receive a hex tool 92 (FIG. 7) that is utilized for manually rotating the lead screw shaft 82. As illustrated in FIGS. 6 and 7, the lead screw shaft 82 with its threads engage the curved half-nut end screw threads 48 of the toe piece 30 to drive the skate truck member 22 laterally with respect to the toe piece 30.

Thus to laterally adjust the toe end of the skate truck member 22 in relation to the toe section of the sole 14, one merely needs to loosen the lock bolts 80 that extend through the apertures 42 and 76, and then operate the drive 25 by rotating the lead screw 82, utilizing a hex tool 92 as illustrated in FIG. 7. FIG. 6 illustrates the toe section 64 of the skate truck member 22 being essentially centered under the toe piece 30. FIG. 7 illustrates the movement of the toe section 64 laterally with respect to the toe piece 30. This enables the skater to readily adjust the skate according to his or her leg structure, to minimize and reduce stress, and to further enable the skate truck member 22 to be pivoted slightly to adjust for the individual pronation of the skater's feet. It should be specifically noted that the toe section 64 may be adjusted laterally by drive 25 independently of lateral movement of the heel section 66, which will be discussed below. Once the proper lateral toe adjustment has been made, the operator merely adjusts the locking bolts 80 that extend through the apertures 42 and 76 to clamp the lead screw against the truck. This prevents further rotation of the lead screw shaft 82.

The third portion of the drive 25 includes a lift 94. The lift 94 advantageously includes a portion of the heel section 66 for enabling the skater to raise or lower the heel 16 of the boot 12 relative to the surface engaging members 24 to accommodate his or her needs. This feature is particularly useful to a skater with legs of different lengths.

The skate truck member 22 includes the lift 94 as an element of the frame 60. The lift 94 includes a wedge 95 supported on a lift support 96 for enabling the skater to adjust the height of the heel piece 32 relative to the surface engaging member 24 to adjust to the height desires of the individual, particularly should the individual have different length legs.

Figure 8B:
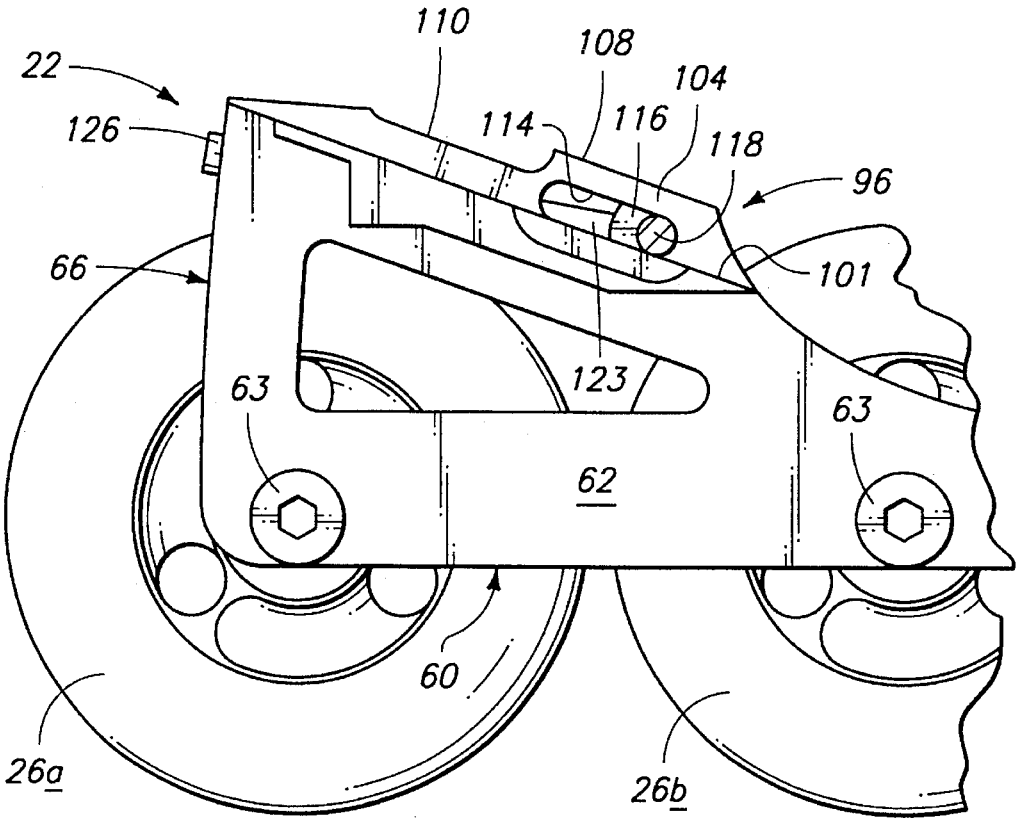
FIG. 8 is a fragmentary side view of a rear portion of the skate truck member with a wedge member removed.
Figure 9:
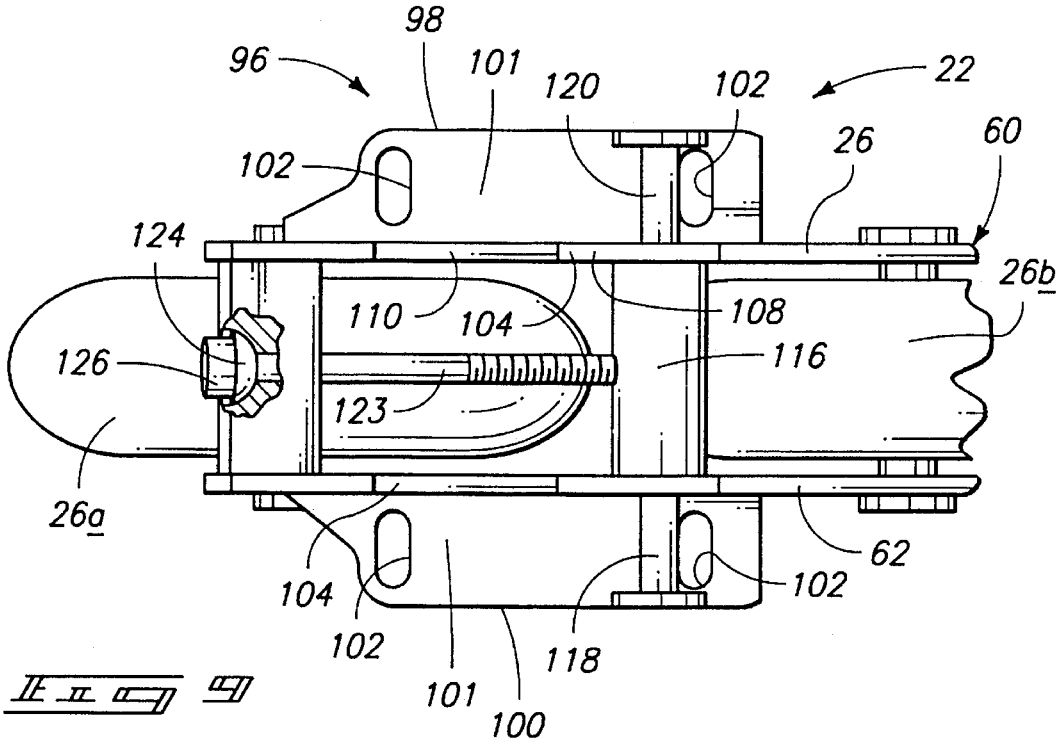
FIG. 9 is a top view of the rear portion of the skate truck member shown in FIG. 8.

The lift support 96 is generally illustrated in FIGS. 8 and 9. The lift support 96 includes side flanges 98 and 100 that extend laterally outward from the sides or rails 62, forming an inclined surface 101. The side flanges 98 and 100 include elongated transverse bolt holes 102 (FIGS. 3, 9) that receive a lock in the form of locking bolts 148 (FIGS. 8, 9). The locking bolts 148 operate similar to the bolts 80 in the elongated apertures 76 of the toe piece 30.

The lift support 96 also includes longitudinal ribs 104 that form inclined ramps having slide bearing surfaces 108. Extending through each of the inclined ribs 104 is an elongated inclined recess 110 for receiving and supporting bearing studs 140 and 142 of a lead screw shaft 138 (described below) to enable the lead screw shaft 138 to move longitudinally as the wedge 95 is raised and lowered.

Additionally, each of the inclined ramps or ribs 104 include similarly inclined elongated slots 114 for threadably receiving bearing and locking bolts 118 and 120 that centrally support a barrel nut 116. Headed ends of the bolts 118 and 120 (FIGS. 1, 11) overlap the wedge 95 and side edges of the lift support 96, so that when the bolts 118, 120 are tightened, the wedge and lift support are clamped securely between the bolt heads. The wedge thus becomes substantially locked against longitudinal movement unless the bolts are loosened.

Figure 10:
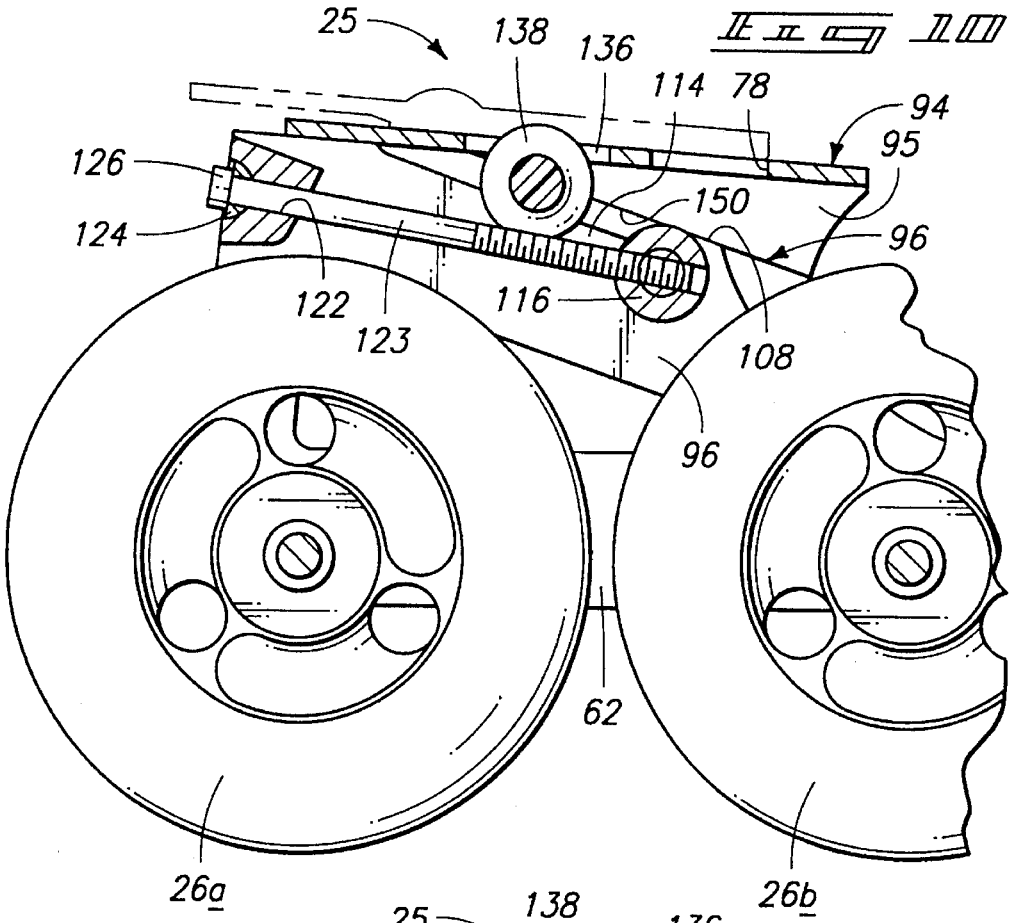
FIG. 10 is a vertical cross sectional view taken along line 10—10 in FIG. 3.

An aperture 122 is formed in the frame at the rear of the skate truck member 22 as illustrated in FIG. 10 for receiving an adjustment screw 123 and a ball washer 124 of the third drive. The adjustment screw 123 has an end that extends into the barrel nut 116. The adjustment screw 124 has a screw head 126 that may be rotated by use of a hex tool (after the bolts 118, 120 are loosened) to move the barrel nut 116 and the lift 94 longitudinally along the lift support 96, particularly the inclined ramps 104.

Figure 3:
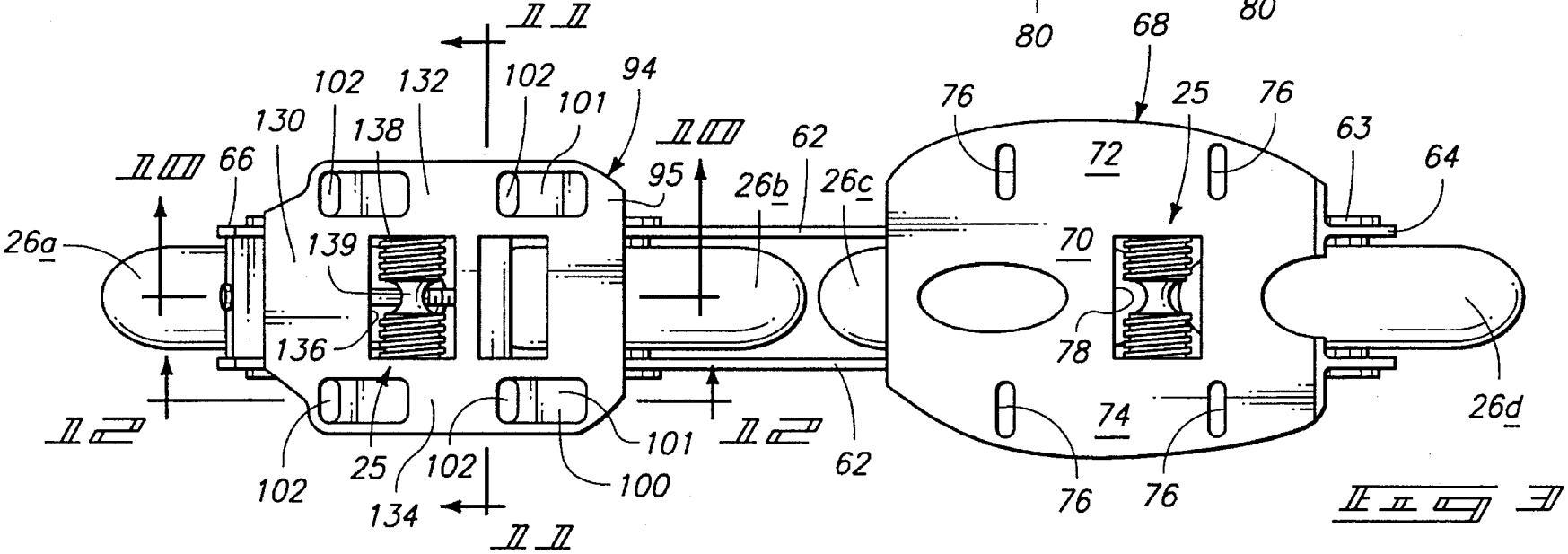
FIG. 3 is top view similar to FIG. 2, except having an upper attaching member removed, illustrating a top view of a skate truck member.
Figure 11:
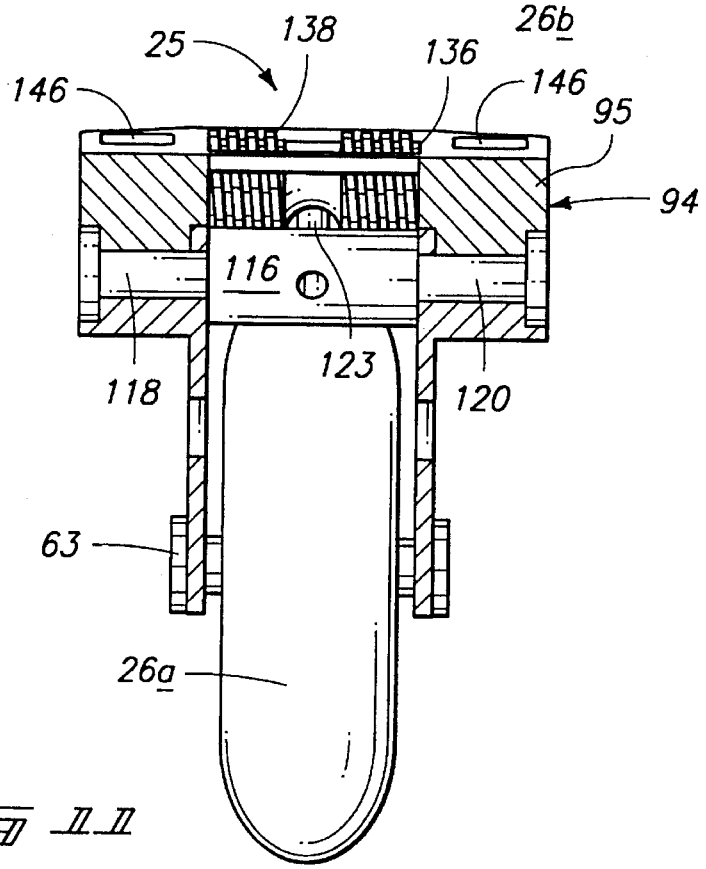
FIG. 11 is a vertical cross sectional view taken along line 11—11 FIG. 3.

The wedge 95 of lift 94 is preferably slidable on the lift support 96 in an inclined upward and downward movement utilizing the rotation of the screw 123. As illustrated in FIG. 3, the wedge 95 includes a central portion 130 with side portions 132 and 134 extending laterally outward from the central portion 130. The side portions 132 and 134 extend out similarly to the wing portions 72 and 74 of the toe section 64. Includes internal ramp surfaces 150 on the wedge slide along the inclined bearing surfaces 108 (FIGS. 10 and 11 ).

Figure 14:
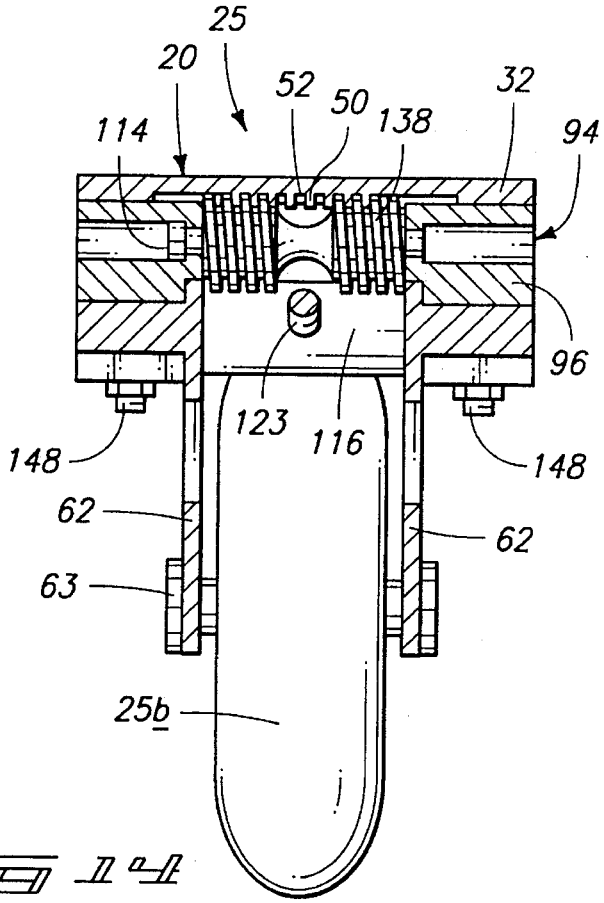
FIG. 14 is an enlarged cross sectional view taken along line 14—14 in FIG. 1.

The wedge 95 includes a central aperture 136 for receiving the lead screw 138 of the second drive portion, that engages the flat threads 52 illustrated in FIGS. 4, 5 and 14. It should be noted that the flat threads 52 of the upper attaching member 20 are longitudinally elongated to accommodate the longitudinal movement of the lead screw 138 as the wedge 95 is moved in inclined motion to elevationally adjust the heel piece 32. The heel piece 32 may also be moved laterally, not only independently of the lateral movement of the toe piece 30, but also independent of the location of the lift 94.

The lead screw 138, as briefly described above, is supported on the lift 94 by stud shafts 140 and 142 which are similar to the bearing stud shafts 84 and 86. Additionally, the stud shaft 142 has a bolt head 144 similar to the head 88 for enabling a hex tool to rotate the lead screw 138 to move the heel section 66 laterally with respect to the heel piece 32. Lead screw 138 includes a central recess 139 (FIGS. 3, 14) to provide clearance for the adjustment screw 123.

If the skater desires to move the skate truck member 22 in a parallel fashion, then the skater will loosen the locking bolts 148 and 80, and then operate the drive 25 by rotating the lead screws 82 and 138 the same number of turns in the same direction to obtain a straight line lateral shift of the upper attaching member 20 (and boot 12) relative to the truck frame 60 and support 24.

It is also possible to adjust the heel independently of the toe. In an accented pronation problem, it may be desirable for the skater to use the drive 25 to move the heel in one lateral direction and the toe in the other lateral direction.

Figure 12:
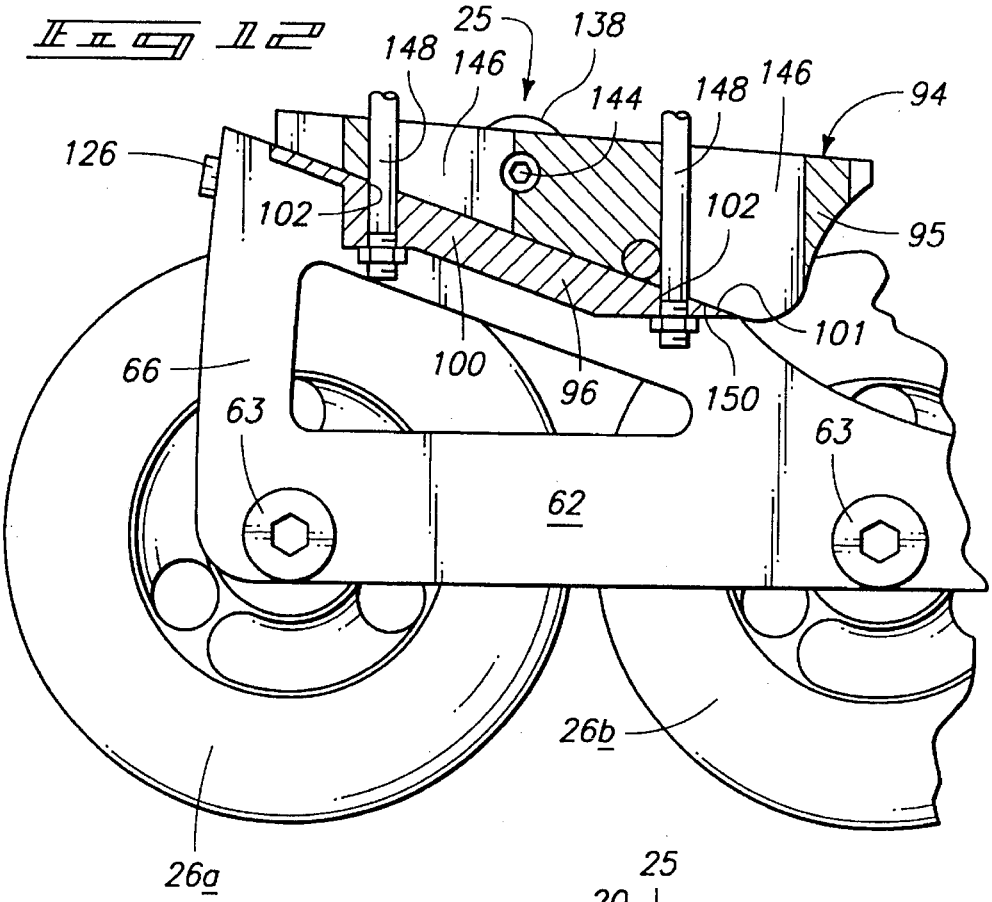
FIG. 12 is a vertical cross sectional view taken along line 12—12 in FIG. 3.
Figure 13:
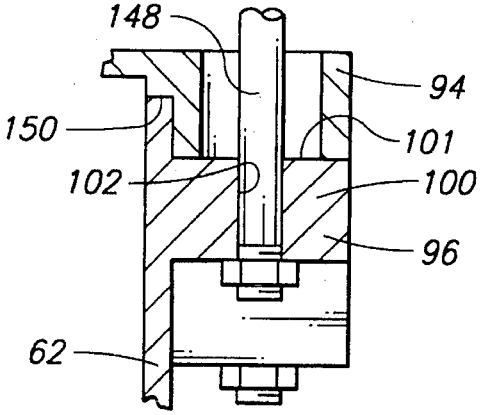
FIG. 13 is a fragmentary enlarged vertical cross sectional view taken along line 13—13 in FIG. 1.

As illustrated in FIGS. 11 and 12, the wedge 95 includes enlarged vertical apertures 146 that receive locking bolts 148. The bolts 148 extend downwardly from the upper attaching member 20 through the wedge apertures 146, and through the transverse bolt holes 102 in the lift support 96. Nuts on the bottom ends of the bolts 148 can be tightened against the lift support to clamp the lift support 96 and wedge 95 securely to the upper attaching member 20, thereby locking them against lateral or longitudinal movement. To adjust the wedge, the skater simply loosens the bolts 148 and the lateral barrel nuts 118, 120.

It can be seen that the skater may not only move the heel section laterally relative to the sole of the boot, but may move the sole upward relative to the surface engaging member 24 to provide not only vertical adjustment, but also lateral adjustment. Since each of the adjustments is independent, each one can be accomplished separately. To provide the lift or vertical movement, one merely releases the lock bolts 148, and the bolts 118, 120 and rotates the adjustment screw 123 to move the wedge 95 upward or downward as desired depending upon the direction and number of rotations of the screw 123. At the same time if the skater desires to move the heel laterally, the skater merely utilizes a hex tool to rotate the lead screw shaft 138 to shift the heel laterally. Once the adjustments are properly made, the skater merely tightens the lock bolts 148 and bolts 118, 120 to lock the skate truck member 22 firmly to the upper attaching member 20.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. An adjustable skate truck assembly mountable to an elongated skate boot having a sole that extends from a heel section to a toe section, comprising:

an upper attachment member for mounting to the sole of the skate boot;

a skate truck member attached to the upper member for relative lateral movement thereto;

an in-line surface support mounted to the skate truck member for engaging a skating surface along a single line beneath the attachment member to enable a skater to propel over the skating surface; and a drive operatively interconnecting the upper attachment member and the skate truck member to move the skate truck member and surface support laterally relative to the upper attachment member to enable the skater to adjust the lateral position of the surface support relative to the upper attachment member.

2. The adjustable skate truck assembly as defined in claim 1 wherein the upper attachment member includes a toe piece and a heel piece and wherein the drive includes operative interconnections to both the toe piece and the heel piece to independently move the skate truck member laterally relative to either the toe piece or the heel piece.

3. The adjustable skate truck assembly as defined in claim 1 wherein the drive includes:

a shaft extending transverse to the boot and rotatably mounted to one of the members; and a drive element mounted to the other member and responsive to the rotation of the shaft to move the other member laterally relative to the one member.

4. The adjustable skate truck assembly as defined in claim 3 wherein the shaft includes a lead screw and wherein the drive element includes a screw rack.

5. The adjustable skate truck assembly as defined in claim 1 further comprising a lock operatively interconnecting the upper member and the skate truck member for selectively preventing relative movement of the skate truck member relative to the upper member.

6. The adjustable skate truck assembly as defined in claim 1 wherein the upper attachment member includes a heel piece and further comprising a lift operatively connected to one of the members for selectively raising or lowering the heel piece relative to the surface support.

7. The adjustable skate truck assembly as defined in claim 6 wherein the lift includes an inclined ramp surface associated with one of the members and a wedge riding on the ramp surface and wherein the drive is operatively connected to the wedge for moving the wedge relative to the ramp surface to raise or lower the heel piece relative to the skate truck member.

8. The adjustable skate truck assembly as defined in claim 7 further comprising a lock operatively interconnecting the members for selectively preventing movement of the wedge.

9. The adjustable skate truck assembly as defined in claim 7 wherein the drive includes barrel nut mounted to the wedge and a threaded adjustment screw rotatably mounted to at least one of the members and extending through the barrel nut for moving the wedge relative to the ramp surface upon rotation of the threaded adjustment screw.

10. An adjustable skate truck assembly mountable to an elongated skate boot having a sole that extends from a heel section to a toe section, comprising:

an upper attachment member having a toe piece for mounting to the toe section of the boot sole and a heel piece for mounting to the heel section of the boot sole;

a skate truck member attached to the upper attachment member for relative lateral movement thereto;

a surface support affixed to the skate truck member for engaging a skating surface to enable a skater to propel over the skating surface; and a first drive operatively interconnecting the toe piece and the skate truck member to move the skate truck member and surface support laterally relative to the toe piece to enable the skater to adjust the lateral position of the surface support relative to the toe section of the skate boot;

a first lock operatively interconnecting the toe piece and the skate truck member for selectively preventing relative movement between the toe piece and the skate truck member;

a second drive independent of the first drive and operatively interconnecting the heel piece and the skate truck member to move the skate truck member and surface support laterally relative to the heel piece to enable the skater to adjust the lateral position of the surface support relative to the heel section of the skate boot independently of the first drive such that the skate truck can be angularly adjusted relative to the upper attachment member; and a second lock independent of the first lock and operatively interconnecting the heel piece and the skate truck member for selectively preventing relative movement between the heel piece and the skate truck member.

11. The adjustable skate truck assembly as defined in claim 10 further comprising a third drive means for elevationally adjusting the height of the heel section of the sole relative to the surface support.

12. The adjustable skate truck assembly as defined in claim 10 wherein the each of the drives includes:

a shaft extending transverse to the boot and rotatably mounted to skate truck member; and a drive element mounted to the upper attachment member and responsive to the rotation of the shaft to move the upper attachment member relative to the skate truck member to laterally adjust the surface support relative to the skate boot.

13. The adjustable skate truck assembly as defined in claim 12 wherein the shaft includes a lead screw and wherein the drive element includes a screw rack.

14. The adjustable skate truck assembly as defined in claim 10 wherein the first and second locks both include a lock bolt for selectively preventing relative movement of the skate truck member relative to the upper attachment member.

15. The adjustable skate truck assembly as defined in claim 10 further comprising a heel lift operatively connected to one of the members for selectively raising or lowering the boot heel relative to the surface support.

16. The adjustable skate truck assembly as defined in claim 15 wherein the heel lift includes an inclined ramp surface associated with the skate truck member and a wedge riding on the ramp surface and a third drive operatively connected to the wedge for moving the wedge relative to the ramp surface to raise or lower the heel of the sole relative to the toe of the sole.

17. The adjustable skate truck assembly as defined in claim 15 further comprising a third lock operatively interconnecting to the heel lift and the skate truck member for selectively preventing movement of the wedge.

18. The adjustable skate truck assembly as defined in claim 10 further comprises a third drive including a barrel nut mounted to the wedge and a threaded shaft rotatably mounted to the skate truck member and extending through the barrel nut.

* * * * *